US005083737A

United States Patent [19]

Rifkin

[11] Patent Number: 5,083,737

[45] Date of Patent: Jan. 28, 1992

[54] PORTABLE WORK HOLDING APPARATUS

[76] Inventor: Louis L. Rifkin, 1450 Wing St., Elgin, Ill. 60123

[21] Appl. No.: 603,171

[22] Filed: Oct. 25, 1990

[51] Int. Cl.[5] ..... A47G 1/24

[52] U.S. Cl. ..... 248/454; 211/88; 248/123.1; 248/447

[58] Field of Search ..... 248/454, 447, 447.1, 248/457, 123.1, 291, 458, 441.1, 453, 163.1, 163.2; 211/88

[56] References Cited

U.S. PATENT DOCUMENTS

| | | | |
|---|---|---|---|
| 1,343,527 | 6/1920 | Stoelzel | 248/454 |
| 2,586,097 | 2/1952 | Scheu . | |
| 2,634,542 | 4/1953 | Bode | 248/457 |
| 2,744,712 | 5/1956 | Brandt . | |
| 3,201,080 | 8/1965 | Rose . | |
| 3,580,653 | 5/1971 | Thomas . | |
| 3,715,097 | 2/1973 | Kalajian . | |
| 3,738,606 | 6/1973 | Millen . | |
| 4,690,363 | 9/1987 | Koves . | |
| 4,699,346 | 10/1987 | Bahm | 248/454 |
| 4,726,556 | 2/1988 | Weir | 248/454 |
| 4,824,064 | 4/1989 | Oncale . | |

*Primary Examiner*—Ramon O. Ramirez

[57] ABSTRACT

A portable work holding apparatus for an artist, a lecturer or other individual includes a work holding board which is mountable on a photographic tripod, the work holding board being adjustable between generally vertical and horizontal orientations, and a work tray is attached to the work holding board by a mounting bracket which is reversible end-to-end and configured to maintain the work tray horizontal for both vertical and horizontal orientations of the work holding board. A weight, such as an artist's supply box, is suspended from the underside of the work holding board near its center to increase the stability of the tripod and work holding apparatus in use.

26 Claims, 4 Drawing Sheets

PORTABLE WORK HOLDING APPARATUS

BACKGROUND OF THE INVENTION

This invention relates to portable apparatus for holding or supporting work materials, and more particularly, to a portable work holding apparatus for use with a camera or photographic tripod so as to be adjustable to a plurality of different orientations including generally vertical and generally horizontal orientations.

Many individuals, such as artists and lecturers often require portable apparatus for supporting their work materials. For example, artists require a support for the canvas panels used in oil painting or the pressed hardboard or paper used when working with water colors, chalk, pencil sketching or other media. Similarly, lecturers require portable apparatus for supporting lecture notes, charts, graphs or the like. It is desirable that the support apparatus be adjustable both in vertical height and angular orientation. This is particularly true when the apparatus is used in applications involving painting because water color painting requires that the water color board be supported in a generally horizontal orientation whereas for oil painting, the canvas is preferably supported in a generally vertical orientation.

In addition to paints and paint brushes, various accessories are required for painting with either oil paints or water colors. For example, such accessories may include a palette for holding the paints or for mixing pigments, a container of water for cleaning the brushes, and a container for storing the brushes when not in use. The containers of liquid paint and water must be maintained in an upright position, generally parallel to the ground, to prevent running of the paints or spilling of the water. Although some known work holding apparatus has included paint palettes and containers for water, such accessories are not adjustably mounted to be properly oriented when the work holder is adjusted from a vertical orientation to a horizontal orientation.

A further consideration is that the portable work holding apparatus must be sturdy when it is set up, particularly if it is used outdoors. The work holding apparatus must be sufficiently sturdy as to avoid being blown over by a gust of wind, or being knocked over inadvertently by the user or some other person.

One known prior art portable work holding apparatus includes a work holder adapted to be attached to a conventional photographic tripod. Such combination provides the desired portability and compactness for the work holding apparatus as well as the adjustability which permits the work holder to be oriented in a generally vertical orientation for oil painting or in a generally horizontal orientation for painting with water colors, for example. However, this apparatus does not provide for adjustable or changeable mounting for accessories and makes no special provision to enhance its stability in use.

SUMMARY OF THE INVENTION

It is, therefore, an object of the present invention to provide a new and improved portable work holding apparatus.

Another object of the invention is to provide a portable work holding apparatus which is of simple construction, compact for transport, and easy to set up for use.

A further object of the invention is to provide a portable work holding apparatus which is sturdy when set up.

Yet another object of the invention is to provide a portable work holding apparatus including a work support which is adjustable between vertical and horizontal orientations and accessories adjustably attachable to the work support for providing convenient access to supplies and the like for the user.

These and other objects are achieved by the present invention which provides a portable work holding apparatus for use with a photographic tripod having a pan head including mounting means, the pan head being adjustable to various orientations. The work holding apparatus comprises a work supporting means which is releasably mountable on the tripod pan head and adjustable therewith to the various orientations including a generally vertical orientation and a generally horizontal orientation. The work holding apparatus further includes an accessory supporting means for supporting accessories, and attachment means for attaching the accessory supporting means to the work supporting means. The attachment means comprises a mounting bracket which is configured in such a way that the accessory supporting means has substantially the same orientation when the work supporting means is oriented either generally vertically or generally horizontally. Further in accordance with the invention, the work holding apparatus comprises stabilizing means for stabilizing the tripod and work holding apparatus in use. The stabilizing means includes suspension means which extends downwardly in pendulum fashion from the underside of the work supporting means and a weight carried by the suspension means.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF A PREFERRED EMBODIMENT

Figure 2:
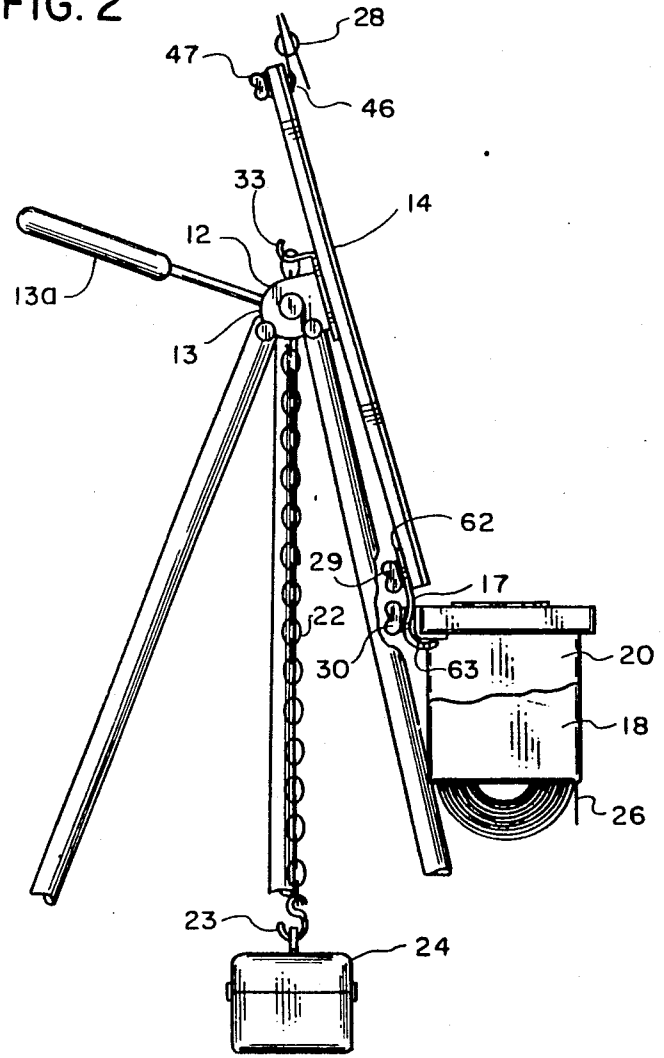
FIG. 2 is a side elevational view of the work holding apparatus illustrated in FIG. 1.
Figure 1:
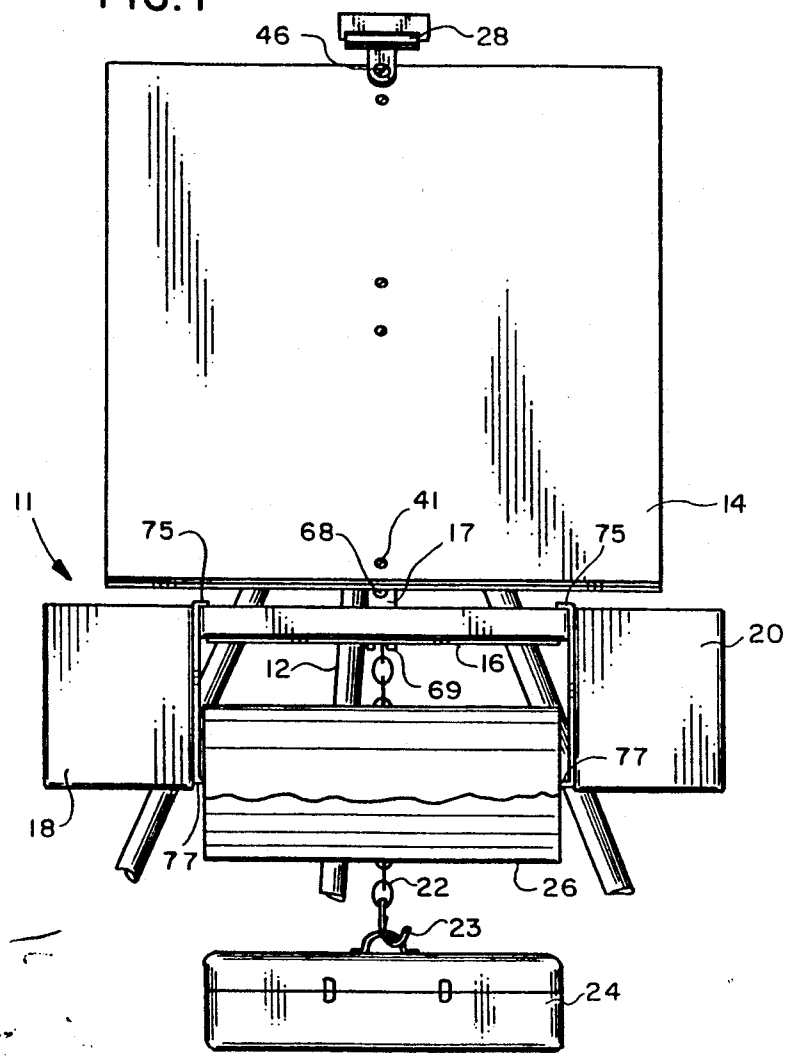
FIG. 1 is a front elevational view of the portable work holding apparatus provided by the present invention shown mounted on a photographic tripod.

Referring to FIGS. 1 and 2, the work holding apparatus 11 provided by the present invention is shown mounted on and supported by a conventional camera or photographic tripod 12. The work holding apparatus 11 includes a work holding board 14, a work tray 16, a mounting bracket 17, and a pair of supply containers 18 and 20.

The work holding board 14 is attached to the pan head 13 of the tripod 12 and is adjustable therewith to different positions or orientations, including generally vertical and generally horizontal orientations, with adjustment of the pan head 13 by operating control handle 13*a*. When the work holding apparatus is used by an artist, the work holding board is used to support a suitable paint receiving medium (not shown) such as stretched canvas, pressed hardboard or the like. Such paint receiving medium is supported on the work holding board and removably affixed thereto in any suitable manner. When the work holding apparatus is used by lecturer, the work holding board is used to support lecture notes, charts, graphs, etc.

In accordance with one aspect of the invention, a stabilizing weight including a chain 22 with a hook 23 at its end are provided for suspending a heavy article, such as the artist's supply box 24 which is used to carry the artist's paints and other items, in pendulum fashion from the underside of the work holding board 14 at a point near the center of the tripod 12. This stabilizes the tripod and work holding apparatus by providing a downward force on the underside of the work holding board. The use of the artist's supply box for this purpose obviates the need to include a weight, or other stabilizing means as a separate item or element of the work holding apparatus.

The work tray 16 is attached by the mounting bracket 17 to the work board 14 near the forward, lower edge 14*a* thereof below the work holding board. When used by an artist, the work tray 16 serves as a palette for mixing pigments and/or holding paints. The two supply containers 18 and 20 are mounted on the work tray 16 at opposite ends thereof. One of the supply containers is used to hold paint brushes, pencils, chalk, erasers, etc. and the other supply container holds water for cleaning paint brushes, for example. In the exemplary embodiment, the supply containers 18 and 20 support a roll of paper towels 26 beneath the work tray 16. However, other items useful by an artist may be supported by the containers. A spring clamp 28 is attached to the work holding board near its upper edge for holding a photograph or the like of a scene, of individuals or of items that the artist is duplicating in paint, for example.

Figure 3:
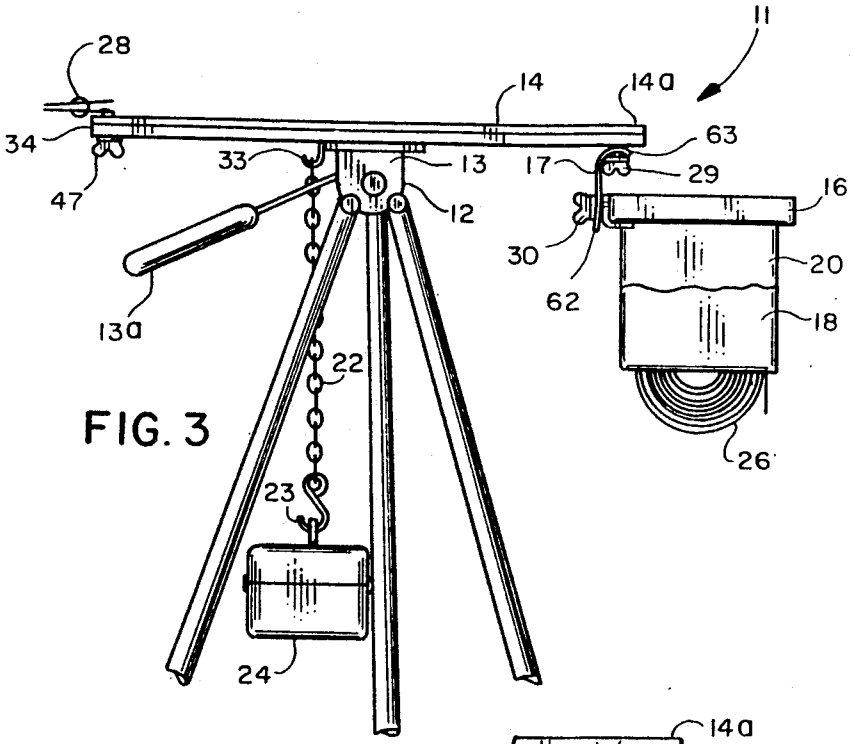
FIG. 3 is a side elevational view of the work holding apparatus shown adjusted to a horizontal position.

The work holding apparatus 11 is shown in FIGS. 1 and 2 to be positioned to be oriented generally vertically for oil painting. The work holding apparatus 11 is adjustable to a generally horizontal position, as illustrated in FIG. 3, for water color applications. The tripod pan head 13 provides for the adjustment, by operating control handle 13*a*, in the attitude of the work holding board 14 and work medium supported thereon.

The mounting bracket 17 is configured so that when it is positioned in a first orientation, illustrated in FIG. 2, the work tray 16 is so attached to the work holding board 14 by mounting bracket 17 and wing nuts 29 and 30 that the work tray 16 and the accessories attached thereto also are maintained in a generally horizontal position, i.e., parallel to the ground. Moreover, when the bracket 17 is inverted end-to-end to be positioned in a second orientation where the work holding board 14 is oriented horizontally, as illustrated in FIG. 3, the work tray 16 and accessories attached thereto also are oriented horizontally. Thus, in accordance with another aspect of the invention, the mounting bracket 17 provides the desired orientation for the work tray 16 and accessories both when the work holding board 14 is oriented generally vertically as illustrated in FIG. 2 and when it is oriented generally horizontally as illustrated in FIG. 3.

Figure 4:
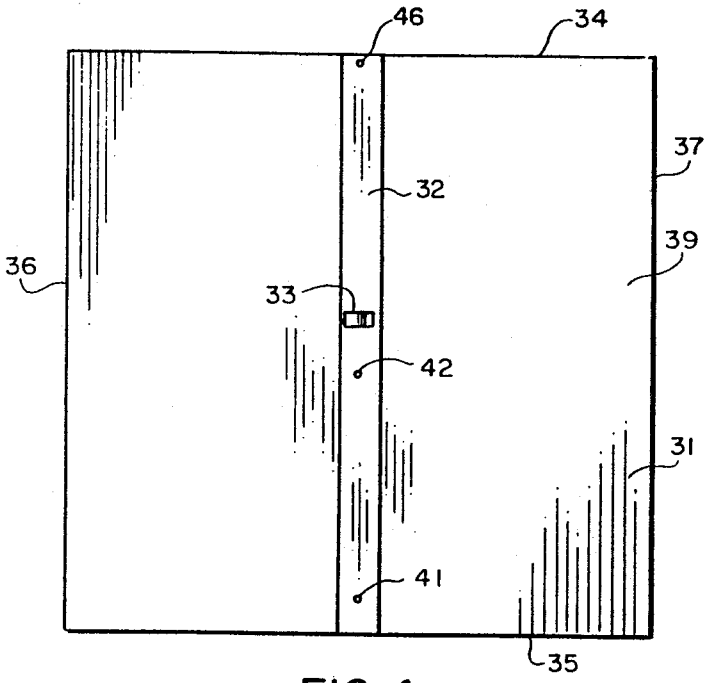
FIG. 4 is a bottom plan view of the work holding board of the work holding apparatus.
Figure 4A:
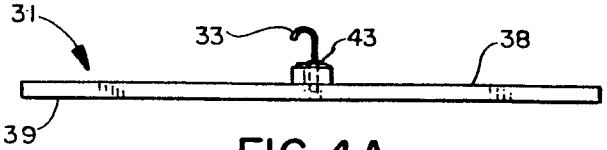
FIG. 4A is an end view of the work holding board illustrated in FIG. 4.

Considering the work holding apparatus 11 in more detail, with reference to FIGS. 2, 4 and 4A, the work holding board 14 comprises a rectangular sheet 31 of a rigid material, such as LUCITE, a reinforcement strip 32 of metal and a hook 33. The sheet 31 has a top edge 34, a bottom edge 35, side edges 36 and 37, a forward surface 38 and a rearward surface 39. The reinforcement strip 32 extends along the rearward surface of the sheet 31 between its top edge 34 and bottom edge 35 and at the center of the sheet 31. The reinforcement strip 32 is attached to the sheet 31 near its top and bottom edges in a suitable manner, such as by screws 41 and 46. Wing nut 29 which secures one end of the bracket 17 to the work holding board is threaded onto screw 41. A threaded aperture 42 in the reinforcement strip 32 facilitates attachment of the work holding board 14 to the pan head 13 of the tripod 12. The hook 33 has a mounting end received in a tapped aperture 43 in reinforcement strip 32 as shown in FIG. 4A. The spring clip 28 (FIG. 2) is removably attached to the work holding board 14 near the upper edge 34 of the sheet 31 by screw 46 and wing nut 47.

Figure 5:
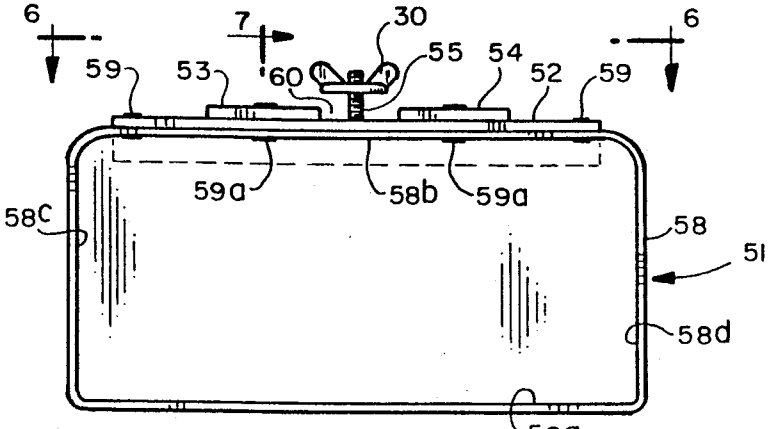
FIG. 5 is a top plan view of a work tray.
Figure 6:
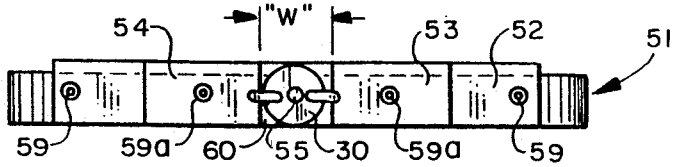
FIG. 6 is a side elevational view taken along the lines 6—6 of FIG. 5.
Figure 7:
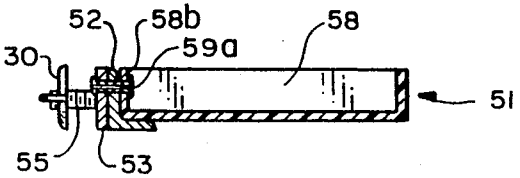
FIG. 7 is a side sectional view taken along the lines 7—7 of FIG. 5.

Referring to FIGS. 5–7, the work tray 16 comprises a shallow, box-like member 51, a metal reinforcement member 52, a pair of steadying bars 53 and 54 of a rigid material, a threaded shaft 55 which carries wing nut 30 for securing the bracket 17 to the work tray 16.

The member 51, which is made of plastic, for example, is generally rectangular in shape and has a short, upstanding peripheral wall 58 having a forward portion 58*a*, a rearward portion 58*b*, and side portions 58*c* and 58*d*. The reinforcement member 52 is in the form of an angle iron and is attached to the member 51 at its rearward side 58*b* as shown in FIG. 7 in a suitable manner, such as with pop rivets 59. The two steadying bars 53 and 54 are mounted on the rearward surface of the reinforcement member 52 in spaced apart relation, defining a channel 60 therebetween. The steadying bars are held in place in a suitable manner such as with pop rivets 59*a*. The threaded shaft 55 is received in a tapped hole in the reinforcement member 52 at the center of the channel 60.

Figure 8:
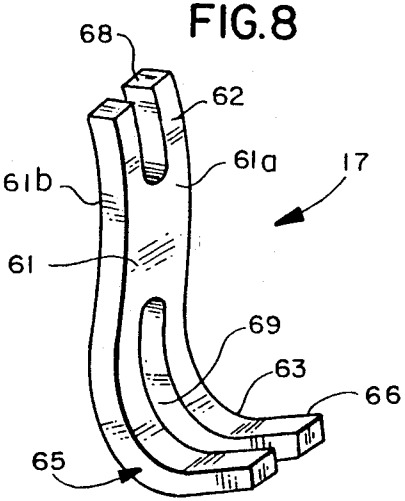
FIG. 8 is a perspective view of a mounting bracket of the work holding apparatus.
Figure 9:
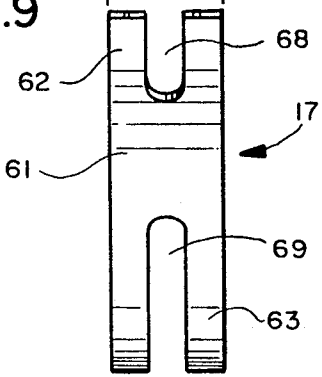
FIG. 9 is a front view of the mounting bracket illustrated in FIG. 8.
Figure 10:
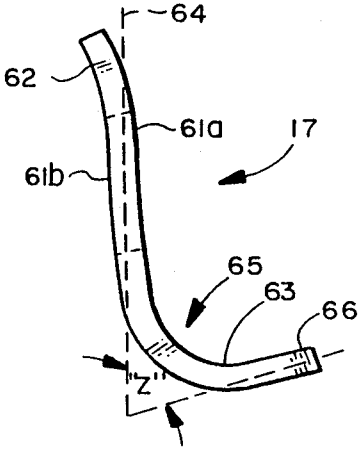
FIG. 10 is a side view of the mounting bracket illustrated in FIG. 8.

Referring to FIGS. 8–10, the reversible mounting bracket 17 is a generally "L" shaped member having a linear, solid portion 61, a first end portion 62 and a second end portion 63. Bracket 17 is made of a rigid metal, such as aluminum. Solid portion 61 extends along a generally vertical axis 64 having a forward surface 61*a* and a rearward surface 61*b*. First end portion 62 of bracket 17 is bent slightly rearwardly of axis 64, outwardly from the rearward surface 61*b*. The second end portion 63 of the bracket 17 has a generally arcuate portion extending outwardly from forward surface 61*a*, defining a forwardly extending hook portion 65 which terminates in a short straight, or linearly extending portion 66 which extends at an angle "Z" relative to axis 64. By way of example, the angle "Z" may be 70°.

The bracket 17 has a longitudinal slot 68 which extends through end portion 62 and an elongated longitudinal slot 69 which extends through end portion 63. The width "W" of the bracket corresponds to the width of the channel 60 (FIG. 6) defined by the steadying bars 53 and 54 of the work tray 16.

Figure 11:
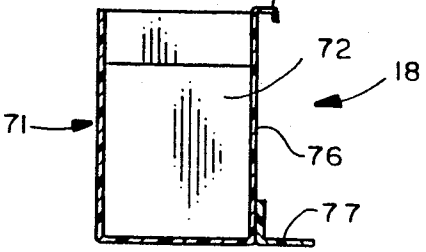
FIG. 11 is a side sectional view of a supply container of the work holding apparatus.
Figure 12:
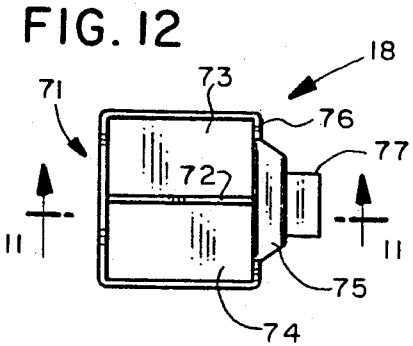
FIG. 12 is a top plan view of the container.
Figure 13:
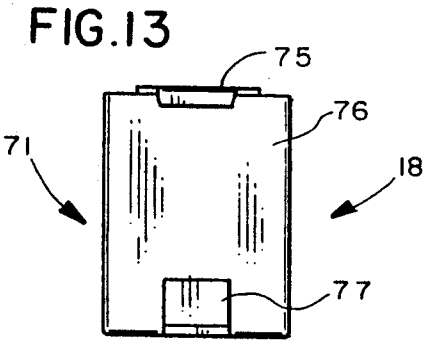
FIG. 13 is a side elevational view of the container illustrated in FIG. 12.

Referring to FIGS. 11–13, each of the supply containers, such as supply container 18 is an elongated, generally rectangular outer box-like structure 71 which is made of a rigid material, such as plastic. The structure 71 has a vertically foreshortened inner wall 72 which divides the container in half, defining a pair of inner compartments 73 and 74. A hook portion 75, formed integrally with one side 76 of the structure 71 extends outwardly and downwardly from side 76 of the container 18, defining an attachment hook for attaching the container to the work tray assembly 16. The structure 71 has a horizontally extending lip portion 77 extending outwardly from side 76 at the bottom of the container, defining a holding or support member for supporting one end of the paper towel roll 26 (FIG. 1).

Figure 14:
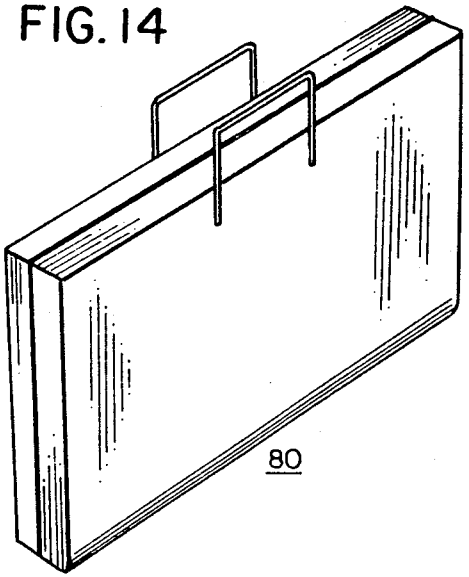
FIG. 14 is a perspective view of a carrying case for the work holding apparatus and tripod.

The components of the work holding apparatus 11 as well as the tripod 12 may be stored conveniently in a case, such as an artist's portfolio case 80 illustrated in FIG. 14, for transport to the work site.

Referring to FIGS. 1, 2, 5 and 8, to assemble the work holding apparatus 11 for use, first the user removes the elements of the work holding apparatus 11 and the tripod 12 from the carrying case 80 (FIG. 14). The user sets up the tripod 12 in the normal manner. Then, the work holding board 14 is mounted on the pan head 13 of the tripod 12 and secured thereto with the camera mount screw (not shown) of the tripod 12 which is received in the tapped aperture 42 of the reinforcement member 32. The work holding board 14 is adjusted to the desired orientation. Assuming the user is an artist who will be using oil paints, the work holding board is adjusted to a generally vertical orientation as illustrated in FIG. 2. Then, the mounting bracket 17 is positioned so that the shank of screw 41 on the work holding board extends in the slot 68 and the wing nut 29 is tightened down to secure the end of the bracket 17 to the work holding board 14. Then, the fork tray 16 is positioned with the shank of screw 55 passing through slot 69 in the other end 63 of the mounting bracket 17 as illustrated in FIG. 2. The solid center portion 61 of the bracket is located in channel 60 of the work tray 16. The wing nut 30 is tightened to secure the work tray 16 to the bracket 17 and thus to the work holding board 14. It is apparent that the bracket 17 can be secured first to the work tray 16, and subsequently the thus assembled work tray and bracket can be attached to the work holding board 14.

Then, the two supply containers 18 and 20 are hung from the work tray assembly 16 at sides 58*c* and 58*d* thereof by way of their hook portions 75. The supply containers 18 and 20 hang free so that they can be pivoted outwardly, slightly about their hook portions 75 to permit their lip portions 77 to be spaced apart relative to one another a sufficient distance as to allow placement of a roll of paper towels 26 between the two containers. When released, the containers 18 and 20 will restore under the force of gravity to a generally vertical position with their lip portions 77 extending into the center tube (not shown) of the paper towel roll. The spring clamp 28 can be mounted on the upper edge of the work holding board if desired.

Figure 3A:
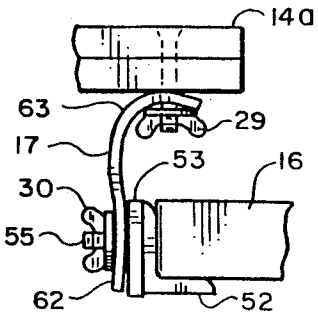
FIG. 3A is an enlarged fragmentary view illustrating connection of a mounting bracket for attaching a work tray to the work holding board of the work holding apparatus.

Assembly of the work holding apparatus 11 is similar when the work holding apparatus 11 is to be oriented in a generally horizontal position, as illustrated in FIGS. 3 and 3A for painting with water colors. However, the mounting bracket 17 is mounted reversed, end-to-end, with its curved end 63 located underlying the forward edge 14*a* of the work holding board 14 and secured thereto by tightening wing nut 29. The center 61 of the mounting bracket 17 is positioned in the channel 60 of the work tray 16. The other end 62 of the mounting bracket is secured to the work tray 16 by tightening the wing nut 30. With this orientation, the work tray 16 as well as the containers 18 and 20 which are hung thereon will extend in a generally horizontal orientation, parallel to the ground.

The chain 22 is attached to the hook 33 carried by the underside of the work holding board 14 and after the artist has removed paints and brushes from the supply case 24, the artist's supply case is placed on the hook 23 at the bottom of the chain 22. This vertical force stabilizes the tripod 12 and the work holding apparatus 11 mounted thereon.

I claim:

1. Portable work holding apparatus for use with a photographic tripod having a pan head including mounting means, the pan head being adjustable to various orientations, said work holding apparatus comprising:

work supporting means releasably mountable on the tripod pan head and adjustable therewith to said various orientations including a generally vertical orientation and a generally horizontal orientation, accessory supporting means for supporting accessories, attachment means for attaching said accessory supporting means to said work supporting means to have a given orientation when said work supporting means is oriented generally vertically and t have substantially the same orientation when said work supporting means is oriented generally horizontally.

2. Apparatus according to claim 1 wherein said attachment means comprises a mounting bracket having a first end and a second end, said mounting bracket being configured in such a way that when said first end of said mounting bracket is secured to said accessory supporting means and said second end of said mounting bracket is secured to said work supporting means, said accessory supporting means has a given orientation when said work supporting means is oriented vertically, and when said second end of said mounting bracket is secured to said accessory supporting means and said first end of said mounting bracket is secured to said work supporting means, the orientation of said accessory supporting means is substantially the same as said given orientation when said work supporting means is oriented generally horizontally.

3. Apparatus according to claim 2 wherein said mounting bracket has a linear portion between said first and second ends, said linear portion having a forward surface and rearward surface, said first end curving outwardly from one of said surfaces and said second curving outwardly from the other one of said surfaces, the length of one of said curved ends being greater than the length of the other curved end and terminating in a portion extending nearly perpendicular to said linear portion, said first and second ends being adapted for attachment to said work supporting means and to said accessory supporting means.

4. Apparatus according to claim 1, wherein said work supporting means has a front edge, said accessory supporting means including a shallow tray-like member, said attachment means attaching said tray-like member to said work supporting means near said front edge and locating said tray-like member at a vertical height below said front edge, said tray-like member having a planar support surface which is oriented substantially horizontally for both generally vertical and horizontal orientations of said work supporting means.

5. Apparatus according to claim 4, wherein said accessory supporting means further includes at least one supply container suspended from said tray-like member.

6. Apparatus according to claim 5, wherein said work supporting means is adapted to support a paint receiving medium and wherein said tray-like member is adapted to contain paints of different colors.

7. Apparatus according to claim 6, wherein said supply container is adapted to contain fluid for rinsing paint brushes, said supply container having an open upper end, said supply container being oriented vertically when suspended from said tray-like member for both vertical and horizontal orientation of said work supporting means.

8. Apparatus according to claim 4, wherein said accessory supporting means further includes first and second supply containers having upper ends mounted on said tray-like member and having lower ends located at a vertical height lower than the vertical height of said tray-like member, said supply containers defining further accessory support means at their lower ends.

9. Apparatus according to claim 1, further comprising stabilizing means including suspension means extending downwardly in pendulum fashion from the underside of said work supporting means and a weight carried by said suspension means.

10. Portable work holding apparatus for use with a photographic tripod having a pan head including mounting means, the pan head being adjustable to various orientations, said work holding apparatus comprising:

work supporting means including means defining a planar work support surface releasably mountable on the tripod pan head and adjustable therewith to said various orientations including a generally vertical orientation and a generally horizontal orientation, accessory supporting means for supporting accessories, attachment means for attaching said accessory supporting means to said work supporting means, said attachment means including a mounting bracket having a first end and a second end, said mounting bracket being configured in such a way that when said first end of said mounting bracket is secured to said accessory supporting means and said second end of said mounting bracket is secured to said work supporting means, said accessory supporting means has a given orientation when said work supporting means is oriented vertically, and when said second end of said mounting bracket is secured to said accessory supporting means and said first end of said mounting bracket is secured to said work supporting means, the orientation of said accessory supporting means is substantially the same as said given orientation when said supporting means is oriented generally horizontally.

11. Apparatus according to claim 10, wherein said mounting bracket has a linear portion between said first and second ends, said linear portion having a forward surface and rearward surface, said first end curving outwardly from one of said surfaces and said second end curving outwardly from the other one of said surfaces, the length of one of said curved ends being greater than the length of the other curved end and terminating in a portion extending nearly perpendicular to said linear portion, said first and second ends each having an opening therein to facilitate attachment to said work supporting means and to said accessory supporting means.

12. Apparatus according to claim 10, wherein said work supporting means has a front edge, said accessory supporting means including a shallow tray-like member, said attachment means attaching said tray-like member to said work supporting means near said front edge and locating said tray-like member at a vertical height below said front edge, said tray-like member having a planar support surface which is oriented substantially horizontally for both generally vertical and horizontal orientations of said work supporting means.

13. Apparatus according to claim 12, wherein said accessory supporting means further includes at least one supply container suspended from said tray-like member.

14. Apparatus according to claim 13, wherein said work supporting means is adapted to support a paint receiving medium and wherein said tray-like member is adapted to contain paints of different colors.

15. Apparatus according to claim 12, wherein said accessory supporting means further includes first and second supply containers having upper ends mounted on said tray-like member and having lower ends located at a vertical height lower than the vertical height of said tray-like member, said supply containers defining further accessory support means at their lower ends.

16. Apparatus according to claim 15, wherein said tray-like member is generally rectangular in shape and has an upstanding wall, with front, rear and side portions, and wherein each of said supply containers has an outwardly extending mounting portion near its upper end adapted to hook over said wall of said tray-like member for mounting said supply container on said tray-like member, said supply containers being mounted on said tray-like member at opposite sides thereof.

17. Apparatus according to claim 10, further comprising stabilizing means including suspension means extending downwardly in pendulum fashion from the underside of said work supporting means and a weight carried by said suspension means.

18. The combination comprising:

a photographic tripod having a pan head including mounting means, the pan head being adjustable to various orientations, and work holding apparatus including work supporting means releasably mountable on said tripod pan head and adjustable therewith to said various orientations including a generally vertical orientation and a generally horizontal orientation, accessory supporting means for supporting accessories, attachment means for attaching said accessory supporting means to said work supporting means to have a given orientation when said work supporting means is oriented generally vertically and to have the same orientation when said work supporting means is oriented generally horizontally.

19. Apparatus according to claim 18 wherein said attachment means comprises a mounting bracket having a first end and a second end, said mounting bracket being configured in such a way that when said first end of said mounting bracket is secured to said accessory supporting means and said second end of said mounting bracket is secured to said work supporting means, said accessory supporting means has a given orientation when said work supporting means is oriented vertically, and when said second end of said mounting bracket is secured to said accessory supporting means and said first end of said mounting bracket is secured to said work supporting means, the orientation of said accessory supporting means is substantially the same as said given orientation when said work supporting means is oriented generally horizontally.

20. Apparatus according to claim 18, wherein said work supporting means has a front edge, said accessory supporting means including a shallow tray-like member, said attachment means attaching said tray-like member to said work supporting means near said front edge and locating said tray-like member at a vertical height below said front edge, said tray-like member having a planar support surface which is oriented substantially horizontally for both generally vertical and horizontal orientations of said work supporting means.

21. Portable work holding apparatus for use with a photographic tripod having a pan head including mounting means, the pan head being adjustable to various orientations, said work holding apparatus comprising:

work supporting means releasably mountable on the tripod pan head and adjustable therewith to said various orientations including a generally vertical orientation and a generally horizontal orientation, and stabilizing means including suspension means having a first securing portion secured to the underside of said work supporting means and a second securing portion adapted to carry a weight, and when said work supporting means is mounted on the tripod, said suspension means extends downwardly from the underside of said work supporting means in pendulum fashion from a point near the center of gravity of the tripod, whereby a weight carried by said suspension means produces a generally vertical force on said work supporting means which is directed downwardly near the center of gravity of the tripod to stabilize the tripod and said work supporting means mounted thereon.

22. Apparatus according to claim 21, further comprising accessory supporting means for supporting accessories, and attachment means including a mounting bracket for attaching said accessory supporting means to said work supporting means to have a given orientation when said work supporting means is oriented generally vertically and to have substantially the same orientation when said work supporting means is oriented generally horizontally.

23. Apparatus according to claim 21 wherein said suspension means includes a hook attached to the under surface of said supporting means and a chain having one end hooked onto said hook, said weight being removably attached to the other end of said chain.

24. Apparatus according to claim 23 wherein said weight comprises a supply box for carrying an artist's paints, brushes, and the like.

25. Apparatus according to claim 21 wherein said suspension means is connected solely to said work supporting means and extends downwardly therefrom free of engagement with the tripod.

26. The combination comprising: a photographic tripod having a pan head including mounting means, the pan head being adjustable to various orientations, and work holding apparatus including work supporting means releasably mounted on the tripod pan head and adjustable therewith to said various orientations including a generally vertical orientation and a generally horizontal orientation, and stabilizing means including a support member attached to the underside of said work supporting means and suspension means having a first securing portion removably secured to said support member and a second securing portion adapted to carry a weight, said suspension means extending downwardly from the underside of said work supporting means in pendulum fashion at a point near the center of gravity of the tripod, whereby a weight removably attached to said second securing portion of said suspension means produces a generally vertical force on said work supporting means which is directed downwardly near the center of gravity of the tripod to stabilize the tripod and said work supporting means mounted thereon.

* * * * *